US009816253B2

(12) United States Patent
Yasuda et al.

(10) Patent No.: US 9,816,253 B2
(45) Date of Patent: Nov. 14, 2017

(54) DISPLAY SYSTEM OF WORK MACHINE, WORK MACHINE, AND DISPLAY METHOD

(71) Applicant: Komatsu Ltd., Tokyo (JP)

(72) Inventors: Yuichiro Yasuda, Fujisawa (JP); Daiki Arimatsu, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 73 days.

(21) Appl. No.: 14/917,394

(22) PCT Filed: Oct. 23, 2015

(86) PCT No.: PCT/JP2015/080033
§ 371 (c)(1),
(2) Date: Mar. 8, 2016

(87) PCT Pub. No.: WO2016/056674
PCT Pub. Date: Apr. 14, 2016

(65) Prior Publication Data
US 2017/0114526 A1 Apr. 27, 2017

(51) Int. Cl.
*G05D 1/02* (2006.01)
*E02F 9/26* (2006.01)
*E02F 3/32* (2006.01)

(52) U.S. Cl.
CPC ..... *E02F 9/261* (2013.01); *E02F 9/264* (2013.01); *E02F 3/32* (2013.01)

(58) Field of Classification Search
CPC ..... E02F 9/261; E02F 9/264; E02F 3/32
See application file for complete search history.

(56) References Cited

U.S. PATENT DOCUMENTS 9,493,929 B2 11/2016 Kurihara et al.
2008/0289108 A1* 11/2008 Menkedick ..... A61G 7/0528 5/610

(Continued)

FOREIGN PATENT DOCUMENTS

JP 2006-200185 A 8/2006
JP 2006-214246 A 8/2006

(Continued)

OTHER PUBLICATIONS

International Search Report and Written Opinion dated Jan. 19, 2016, issued for PCT/JP2015/080033.

*Primary Examiner* — Adam Alharbi
(74) *Attorney, Agent, or Firm* — Locke Lord LLP

(57) ABSTRACT

A display system of a work machine having a working unit with a bucket attached thereto, includes a generation unit generating drawing information to draw an image of the bucket viewed from a side using information of shape and size of the bucket, and a display unit displaying the image of the bucket viewed from the side and an image indicating a cross-section of landform based on the drawing information. The information of the shape and size includes, in the side view of the bucket, a distance between a blade edge of the bucket and a bucket pin attaching the bucket to the working unit, a distance between the bucket pin and a predetermined position at an outer side of the bucket, and an angle formed by a straight line connecting the bucket pin and the blade edge and a straight line connecting the bucket pin and the predetermined position.

8 Claims, 10 Drawing Sheets

(56) References Cited

U.S. PATENT DOCUMENTS

| | | | | |
|---|---|---|---|---|
| 2014/0100712 | A1* | 4/2014 | Nomura | E02F 3/32 701/1 |
| 2015/0218781 | A1* | 8/2015 | Nomura | E02F 3/435 701/50 |
| 2016/0010312 | A1 | 1/2016 | Kurihara et al. | |
| 2016/0054114 | A1* | 2/2016 | Crozier | G01B 11/14 702/151 |

FOREIGN PATENT DOCUMENTS

| | | | |
|---|---|---|---|
| JP | 2012-172431 | A | 9/2012 |
| JP | 2014-101664 | A | 6/2014 |
| KR | 10-2015-0067369 | A | 6/2015 |

* cited by examiner

DISPLAY SYSTEM OF WORK MACHINE, WORK MACHINE, AND DISPLAY METHOD

FIELD

The present invention relates to a display system of a work machine, a work machine, and a display method.

BACKGROUND

Generally, an operator operates an operating lever of a work machine such as an excavator, and a working unit, including a bucket, is thereby driven for construction such as excavation of the ground or the like as a work object. For example, in Patent Literature 1, an image of a bucket viewed from the side is displayed on a display unit.

CITATION LIST

Patent Literature

Patent Literature 1: Japanese Laid-open Patent Publication No. 2012-172431

SUMMARY

Technical Problem

In a case where the type of bucket attached to a working unit is changed, if a shape of the bucket displayed on a display unit is not corresponding to a shape of the modified bucket, the relationship between the bucket displayed on the display unit and the target surface may not be displayed properly when the changed bucket is indicated to an operator of a work machine. As a result, there is a possibility of giving discomfort to the operator of the work machine.

An object of the present invention is to reduce the discomfort to the operator when displaying several types of buckets on the display unit.

Solution to Problem

According to the present invention, a display system of a work machine that has a working unit with a bucket attached thereto, the display system of the work machine comprises a generation unit that generates drawing information to draw an image of the bucket viewed from a side using information of shape and size of the bucket, and a display unit that displays the image of the bucket viewed from the side and an image that indicates a cross-section of landform based on the drawing information generated by the generation unit. The information of the shape and size of the bucket includes, in the side view of the bucket, a distance between a blade edge of the bucket and a bucket pin that attaches the bucket to the working unit, an angle formed by a straight line that connects the blade edge and the bucket pin and a straight line that indicates a bottom surface of the bucket, a position of the blade edge, a position of the bucket pin, and at least one position on the outer side of the bucket between a portion that couples the bucket to the working unit and the blade edge.

According to the present invention, a display system of a work machine that has a working unit with a bucket attached thereto, the display system of the work machine comprises a generation unit that generates drawing information to draw an image of the bucket viewed from the side using information of shape and size of the bucket, and a display unit that displays the image of the bucket viewed from the side and an image indicating a cross-section of landform based on the drawing information generated by the generation unit. The information of the shape and size of the bucket includes, in the side view of the bucket, a distance between a blade edge of the bucket and a bucket pin that attaches the bucket to the working unit, an angle formed by a straight line that connects the blade edge and the bucket pin and a straight line that indicates a bottom surface of the bucket, a position of the blade edge, a position of the bucket pin, and at least one position on the outer side of the bucket between a portion that couples the bucket to the working unit and the blade edge.

According to the present invention, a display system of a work machine that has a working unit with a bucket attached thereto, the display system of the work machine comprises a generation unit that generates drawing information to draw an image of the bucket viewed from the side using information of shape and size of the bucket, and a display unit that displays the image of the bucket viewed from the side and an image that indicates a cross-section of landform based on the drawing information generated by the generation unit. The information of the shape and size of the bucket includes, in the side view of the bucket, a distance between a blade edge of the bucket and a bucket pin that attaches the bucket to the working unit, an angle formed by a straight line that connects the blade edge and the bucket pin and a straight line indicating a bottom surface of the bucket, a length of the bottom surface of the bucket viewed from the side, a length from the bucket pin to at least one position on the outer side of the bucket between a portion that couples the bucket to the working unit and the blade edge, an angle formed by a straight line that connects the blade edge and the bucket pin and a straight line from the bucket pin to at least one position on the outer side of the bucket between the portion that couples the bucket to the working unit and the blade edge, a length of, in the side view of the bucket, a straight line that connects the bucket pin and a position of a bucket rear side end at the bottom surface, and an angle formed by a straight line that connects the blade edge and the bucket pin and a straight line that connects the bucket pin and the position of the bucket rear side end at the bottom surface.

In the present invention, it is preferable that the generation unit changes first drawing information of a first portion which is a portion that couples a bucket cylinder that drives the bucket and an arm of the working unit to the bucket and second drawing information of a second portion which is a portion from the first portion to the blade edge, based on the information of the shape and size of the bucket using the first drawing information and the second drawing information, obtains third drawing information by generating information of a figure that passes through at least one position on the outer side of the bucket, the position being between the blade edge and the first portion, and generates the drawing information using the first drawing information, the second drawing information, and the third drawing information.

In the present invention, it is preferable that the display unit displays, together with the image of the bucket viewed from the side, information of a target construction surface indicating a target shape of a construction object of the work machine.

According to the present invention, a work machine comprises the display system of the work machine described above.

According to the present invention, a display method comprises generating drawing information to draw an image of a bucket, included in a work machine, viewed from the side using information of shape and size of the bucket, and displaying the image of the bucket viewed from the side and an image indicating a cross-section of landform based on the drawing information generated by the generation unit. The information of the shape and size of the bucket includes, in the side view of the bucket, a distance between a blade edge of the bucket and a bucket pin that attaches the bucket to the working unit, a distance between the bucket pin and a predetermined position at an outer side of the bucket, and an angle formed by a straight line that connects the bucket pin and the blade edge of the bucket and a straight line that connects the bucket pin and the predetermined position.

According to the present invention, a display method comprises generating drawing information to draw an image of a bucket, included in a work machine, viewed from the side using information of shape and size of the bucket, and displaying the image of the bucket viewed from the side and an image indicating a cross-section of landform based on the drawing information generated by the generation unit. The information of the shape and size of the bucket includes, in the side view of the bucket, a distance between a blade edge of the bucket and a bucket pin that attaches the bucket to the working unit, an angle formed by a straight line that connects the blade edge and the bucket pin and a straight line indicating a bottom surface of the bucket, a length of the bottom surface of the bucket viewed from the side, a length from the bucket pin to at least one position on the outer side of the bucket between a portion that couples the bucket to the working unit and the blade edge, an angle formed by a straight line that connects the blade edge and the bucket pin and a straight line from the bucket pin to at least one position on the outer side of the bucket between the portion that couples the bucket to the working unit and the blade edge, a length of, in the side view of the bucket, a straight line that connects the bucket pin and a position of a bucket rear side end at the bottom surface, and an angle formed by a straight line that connects the blade edge and the bucket pin and a straight line that connects the bucket pin and the position of the bucket rear side end at the bottom surface.

It is preferable to change first drawing information of a first portion which is a portion that couples the bucket cylinder that drives the bucket and an arm of the working unit to the bucket and second drawing information of a second portion which is a portion from the first portion to the blade edge based on the information of the shape and size of the bucket using the first drawing information and the second drawing information, obtain third drawing information by generating information of a figure that passes through at least one position on the outer side of the bucket, the position being between the blade edge and the first portion, and generate the drawing information using the first drawing information, the second drawing information, and the third drawing information.

The present invention can reduce the discomfort to the operator when displaying several types of buckets on the display unit.

DESCRIPTION OF EMBODIMENTS

A mode to implement (embodiment of) the present invention will be described in detail with reference to the drawings.

<Overall Configuration of Work Machine>

Figure 1:
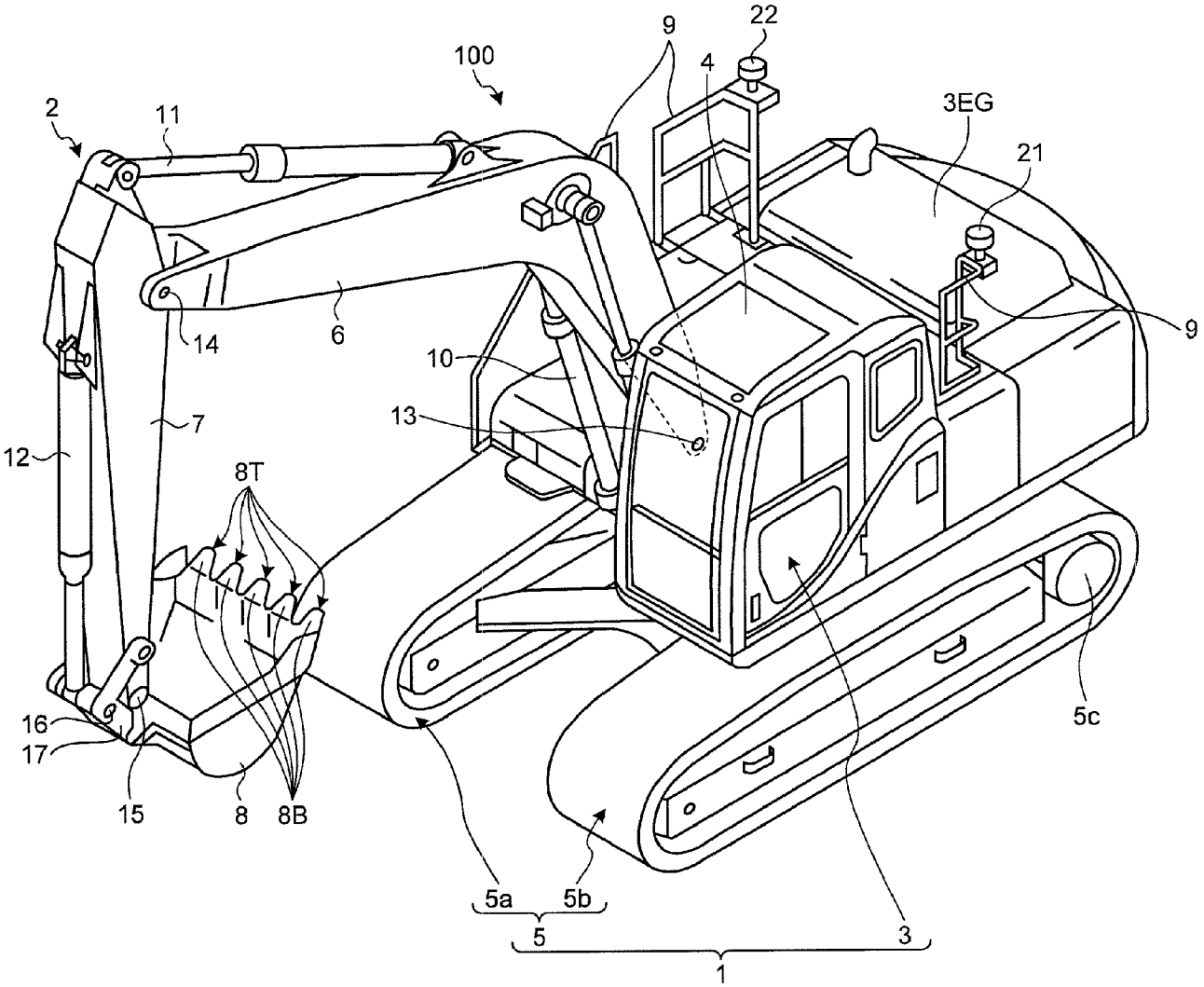
FIG. 1 is a perspective view illustrating a work machine according to an embodiment.

FIG. 1 is a perspective view illustrating a work machine according to an embodiment. An excavator 100 being an example of a work machine has a vehicle main body 1 as a main body portion, and a working unit 2. The vehicle main body 1 has an upper swing body 3 which is a swing body, and a traveling device 5 as a traveling body. The upper swing body 3 accommodates devices such as an engine which is a power generation device, and a hydraulic pump inside a machine room 3EG.

In the embodiment, the excavator 100 uses, for example, an internal combustion engine such as a diesel engine as an engine which is a power generation device, but the power generation device is not limited to the internal combustion engine. The power generation device of the excavator 100 may be a so-called hybrid device, which is, for example, a combination of an internal combustion engine, a generator motor, and a power storage device. In addition, the power generation device of the excavator 100 may be a device obtained by combining the power storage device and the generator motor without the internal combustion engine.

Figure 2:
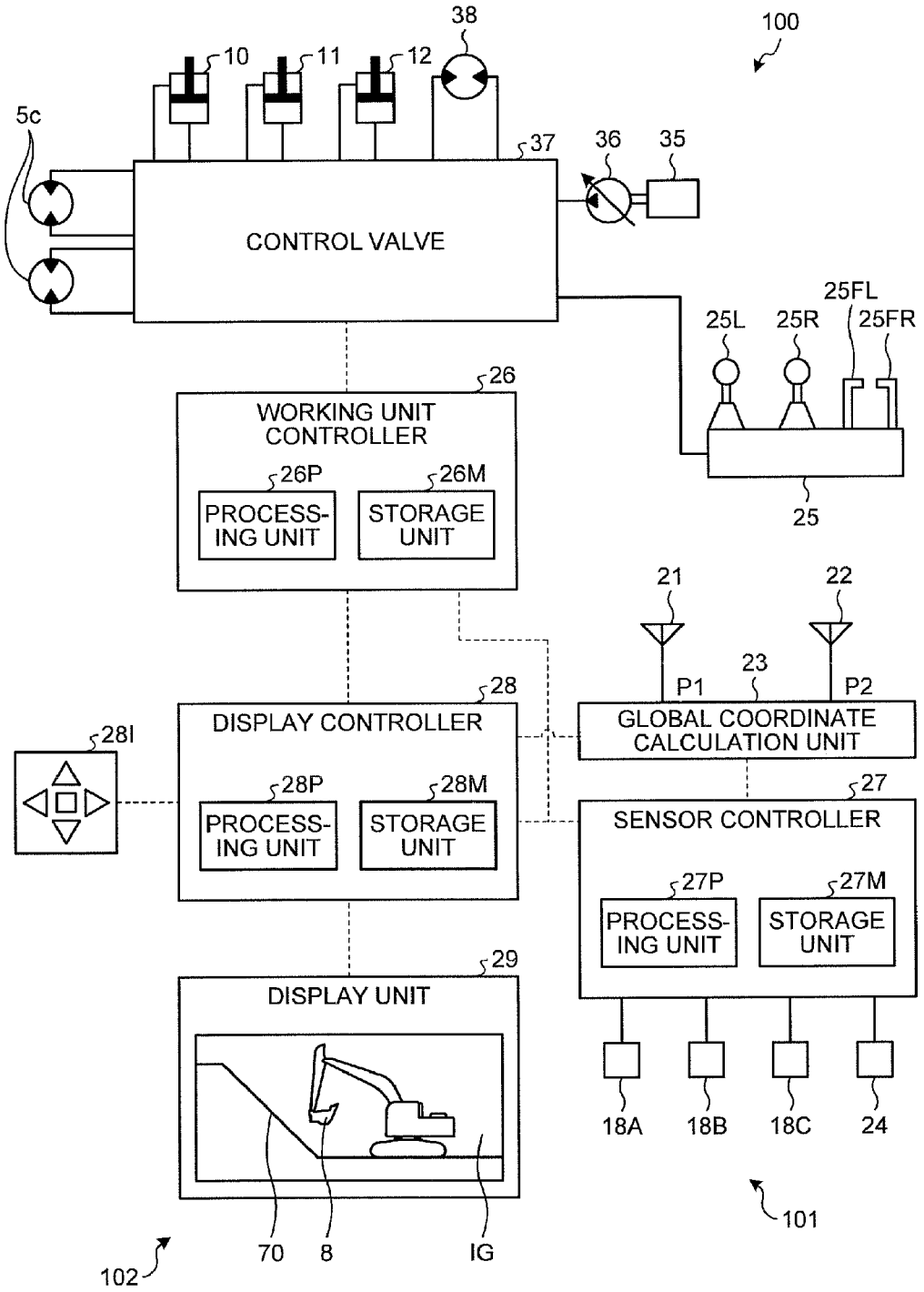
FIG. 2 is a diagram illustrating a control system of an excavator.

The upper swing body 3 has an operator room 4. The operator room 4 is placed on the other end side of the upper swing body 3. That is, the operator room 4 is arranged at a side opposite to the machine room 3EG. In the operator room 4, a display unit 29 and an operating device 25 illustrated in FIG. 2 are arranged. A handrail 9 is attached on the upper swing body 3.

The upper swing body 3 is mounted on the traveling device 5. The traveling device 5 has crawler tracks 5*a* and 5*b*. The traveling device 5 is driven by one of, or both of hydraulic motors 5*c* provided on the left and right sides. By rotating the crawler tracks 5*a* and 5*b* of the traveling device 5, the excavator 100 is caused to travel. The working unit 2 is attached to the side of the operator room 4 of the upper swing body 3.

The working unit 2 has a boom 6, an arm 7, a bucket 8 which is an example of working tools, a boom cylinder 10, an arm cylinder 11, and a bucket cylinder 12. A base end portion of the boom 6 is turnably attached to a front portion of the vehicle main body 1 via a boom pin 13. A base end portion of the arm 7 is turnably attached to a tip portion of the boom 6 via an arm pin 14. The bucket 8 is attached to a tip portion of the arm 7 via a bucket pin 15. The bucket 8 is coupled to the bucket cylinder 12 via a link pin 16 and a link 17. The bucket 8 turns about the bucket pin 15. The bucket 8 has a plurality of blades 8B attached on the opposite side to the bucket pin 15. A blade edge 8T is a tip of the blade 8B.

The bucket 8 does not need to have a plurality of blades 8B. In other words, the bucket 8 may be a bucket in which the blade edge is formed in a straight shape by a steel sheet without having the plurality of blades 8B as illustrated in FIG. 1. The working unit 2 may have, for example, a tilt bucket. The tilt bucket has a bucket tilt cylinder, and the tilt bucket can form slopes and flatlands into any shapes and can level slopes and flatlands by the tilt of the bucket to left and right even if the excavator 100 is on a sloping land. The bucket 8 may be a bucket capable of roller compaction work by a bottom plate.

The boom cylinder 10, the arm cylinder 11, and the bucket cylinder 12 illustrated in FIG. 1 are each a hydraulic cylinder driven by pressure of working oil. Hereinafter, the pressure of working oil is appropriately referred to as hydraulic pressure. The boom cylinder 10 drives the boom 6 to elevate and lower the boom 6. The arm cylinder 11 drives the arm 7 to make the arm 7 turn around the arm pin 14. The bucket cylinder 12 drives the bucket 8 to make the bucket 8 turn around the bucket pin 15.

Antennas 21 and 22 are provided above the upper swing body 3. The antennas 21 and 22 are used for detecting the current position of the excavator 100. The antennas 21 and 22 are electrically connected to a global coordinate calculation unit 23 illustrated in FIG. 2.

FIG. 2 is a diagram illustrating a control system 101 for the excavator 100. The control system 101 controls operation of the excavator 100 such as traveling, operation of the working unit 2, and operation of the upper swing body 3. In the embodiment, the control system 101 includes the global coordinate calculation unit 23, the operating device 25, a working unit controller 26, a sensor controller 27, a display controller 28, and the display unit 29. Within the control system 101, the display controller 28 and the display unit 29 are a display system 102 according to the embodiment. The operating device 25 controls, by controlling a control valve 37, the flow rate of the working oil fed to the swing motor 38 that swings the boom cylinder 10, the arm cylinder 11, the bucket cylinder 12, the hydraulic motor 5*c*, and the upper swing body 3 from a hydraulic pump 36 driven by an internal combustion engine 35.

The global coordinate calculation unit 23 is a position detection device that detects the position of the excavator 100. The global coordinate calculation unit 23 is a position detection device that detects the current position of the excavator 100 using the real time kinematic-global navigation satellite systems (RTK-GNSS). In the following description, the antennas 21 and 22 are appropriately referred to as GNSS antennas 21 and 22. A signal according to a GNSS radio wave received by the GNSS antennas 21 and 22 is input to the global coordinate calculation unit 23. The global coordinate calculation unit 23 determines the setting positions of the GNSS antennas 21 and 22 in the global coordinate system.

The global coordinate calculation unit 23 obtains two reference position data P1 and P2 represented by the global coordinate system. The global coordinate calculation unit 23 generates swing body arrangement data indicating the arrangement of the upper swing body 3 based on the two reference position data P1 and P2. In the embodiment, the swing body arrangement data includes the reference position data P1 and/or P2, and information of orientation of the upper swing body 3 generated based on the two reference position data P1 and P2. The two GNSS antennas 21 and 22 may configure a GPS compass, and may obtain the information of the orientation of the upper swing body 3. In other words, the global coordinate calculation unit 23 may calculate an orientation angle from the relative position of the two GNSS antennas 21 and 22 without outputting the reference position data P1 and P2 of both of the GNSS antennas 21 and 22, and determine the orientation angle as an orientation of the swing body.

The operating device 25 has a left operating lever 25L, a right operating lever 25R, a left traveling lever 25FL, and a right traveling lever 25FR. The operator of the excavator 100, by operating the left operating lever 25L and the right operating lever 25R, controls operation of the working unit 2 and the upper swing body 3 and performs construction, such as excavation, to the ground or the like which is the work object. The operator drives the hydraulic motor 5*c* to cause the excavator 100 to travel by operating the left traveling lever 25FL and the right traveling lever 25FR. In the embodiment, the left operating lever 25L, the right operating lever 25R, the left traveling lever 25FL, and the right traveling lever 25FR are levers of a pilot pressure system, but are not limited to this. The left operating lever 25L, the right operating lever 25R, the left traveling lever 25FL, and the right traveling lever 25FR may be, for example, levers of an electric system.

The working unit controller 26, which is an example of a working unit control unit, has a processing unit 26P and a storage unit 26M. The working unit controller 26 is a device that controls the operation of the working unit 2. The processing unit 26P controls the operation of the working unit 2, and the storage unit 26M stores necessary computer programs and control data for controlling the operation of the working unit 2. During construction by the excavator 100, the working unit 2 is controlled so that the position of the working unit 2, which is the position of the blade edge 8T of the bucket 8 in the embodiment, does not invade the target construction surface indicating the target shape of the construction object. This control is appropriately referred to as working unit control. In the embodiment, the position of the blade edge 8T is determined by the display controller 28, but it may be determined by a device other than the display controller 28.

The sensor controller 27 has a processing unit 27P and a storage unit 27M. Various sensors that detect the state of the excavator 100 are connected to the sensor controller 27. The sensor controller 27 converts information obtained from the various sensors into a format that can be handled by other devices included in the excavator 100, and then outputs the information. The information of the state of the excavator 100 includes, for example, information of a posture of the excavator 100 and information of a posture of the working unit 2. In the example illustrated in FIG. 2, as the sensors that detect the information of the state of the excavator 100, an inertial measurement unit (IMU) 24, a first working unit posture detection unit 18A, a second working unit posture detection unit 18B, and a third working unit posture detection unit 18C are connected to the sensor controller 27, but the sensors connected thereto are not limited to these.

The IMU 24 detects an angular velocity and acceleration of the excavator 100. A posture angle of the excavator 100 is obtained from the angular velocity and the acceleration of the excavator 100. The first working unit posture detection unit 18A detects the operation amount of the boom cylinder 10. The second working unit posture detection unit 18B detects the operation amount of the arm cylinder 11. The third working unit posture detection unit 180 detects the operation amount of the bucket cylinder 12. From the operation amount of the boom cylinder 10, the operation amount of the arm cylinder 11, and the operation amount of the bucket cylinder 12, the information representing the posture of the working unit 2 is obtained. The information representing the posture of the working unit 2 is defined by, for example, an angle θ1 formed by the boom 6 and the upper swing body 3, an angle θ2 formed by the boom 6 and the arm 7, and an angle θ3 formed by the arm 7 and the bucket 8. The first working unit posture detection unit 18A, the second working unit posture detection unit 18B, and the third working unit posture detection unit 18C may be potentiometers that detect the angle θ1, the angle θ2, and the angle θ3.

The sensor controller 27 obtains the information of the position of the excavator 100 in the global coordinate and the orientation of the upper swing body 3 determined by the global coordinate calculation unit 23, the information of the angular velocity and the acceleration of the excavator 100 obtained by the IMU 24, and the information representing the posture of the working unit 2. The sensor controller 27 outputs the obtained information of the position of the excavator 100 in the global coordinate and the orientation of the upper swing body 3 and the information representing the posture of the working unit 2 to the display controller 28. The processing unit 27P of the sensor controller 27 implements the functions of the sensor controller 27. The storage unit 27M stores a computer program and data necessary for implementing the functions of the sensor controller 27.

The display controller 28 has a processing unit 28P and a storage unit 28M. The display unit 29 is connected to the display controller 28. The display unit 29 is a device that displays an image and, for example, a touch panel having an operation function and a display function can be used. For example, a liquid crystal display panel or an organic electroluminescence (EL) panel is used for the display unit 29. The display controller 28 generates drawing information of the image displayed on the display unit 29. In the example illustrated in FIG. 2, an example of a guidance image IG when the excavator 100 is engaged in construction of the construction object is displayed on the display unit 29. The guidance image IG is an image in the state of the excavator 100 and the bucket 8 viewed from the side, that is, when the bucket 8 is viewed from the side.

In addition, on the guidance image IG, for example, a line indicating the cross-section of a target construction surface 70 which indicates the target shape of the construction object (a target construction surface line 79 described later), a ground-contacting surface of the excavator 100 which is not the construction object, and a line indicating the cross-section of the surrounding ground are displayed. In other words, the display controller 28 displays an image that indicates the cross-section of the landform on the guidance image IG. On the guidance image IG, the whole excavator 100 including the bucket 8 may be displayed, or the extracted bucket 8 including the working unit 2 may be displayed. Alternatively, the extracted bucket 8 may be displayed on the guidance image IG.

The display controller 28 determines the position of the working unit 2 using the position of the excavator 100 in the global coordinate and the orientation of the upper swing body 3 obtained from the sensor controller 27, the information representing the posture of the working unit 2, and the information indicating the size of the working unit 2. The information that indicates the size of the working unit 2 is, for example, stored in advance in the storage unit 28M of the display controller 28. The position of the working unit 2 determined by the display controller 28 is, for example, a position of the blade edge 8T of the bucket 8. The position of the blade edge 8T of the bucket 8 determined by the display controller 28 is a position in the global coordinate system. The display controller 28 simultaneously displays the determined position of the blade edge 8T and the target construction surface 70 on the display unit 29 in a case where the guidance image IG is displayed on the display unit 29. The operator of the excavator 100 can easily grasp the positional relationship between the positions of the blade edge 8T and the target construction surface 70 from the guidance image IG displayed on the display unit 29, and therefore, the working efficiency is improved. In the embodiment, the position of the blade edge 8T is determined by the display controller 28, but it may be determined by a device other than the display controller 28.

The display controller 28, for example, generates drawing information to draw the side of the bucket 8 using information of the shape and size of the bucket 8 in a case where the guidance image IG is displayed on the display unit 29. In the embodiment, the display controller 28 is an example of the generation unit. The display unit 29 displays the image of the side of the bucket 8 based on the drawing information generated by the display controller 28.

The processing unit 28P of the display controller 28 implements the functions of the display controller 28 such as generating the drawing information to draw an image of the bucket 8 viewed from the side, and generating the drawing information of the target construction surface 70 included in the guidance image IG. The storage unit 28M stores a computer program and data necessary for implementing the functions of the display controller 28. The data includes, for example, information of a designed landform for generating the target construction surface 70, and the information of the size of the working unit 2.

An input device 281 is connected to the display controller 28. The input device 281 inputs the information of the shape and size of the bucket 8 to the display controller 28, and outputs a command for switching a display of the display unit 29 to the display controller 28. In the embodiment, the input device 281 is configured of a touch panel, or an operating member of a hard key, a switch, or the like. In a case where the input device 281 is of a touch panel type, the display unit 29 is a touch panel as described above, and the input device 281 and the display unit 29 are integrated with each other.

The processing unit 26P of the working unit controller 26, the processing unit 27P of the sensor controller 27, and the processing unit 28P of the display controller 28 are implemented with a processor such as a central processing unit (CPU), and a memory. At least one of a nonvolatile or volatile semiconductor memory such as a random access memory (RAM), a random access memory (ROM), a flash memory, an erasable programmable random access memory (EPROM), and an electrically erasable programmable random access memory (EEPROM), a magnetic disk, a flexible disk, and a magnetic optical disk is used for the storage unit 26M of the working unit controller 26, the storage unit 27M of the sensor controller 27, and the storage unit 28M of the display controller 28.

<Guidance Image IG>

Figure 3:
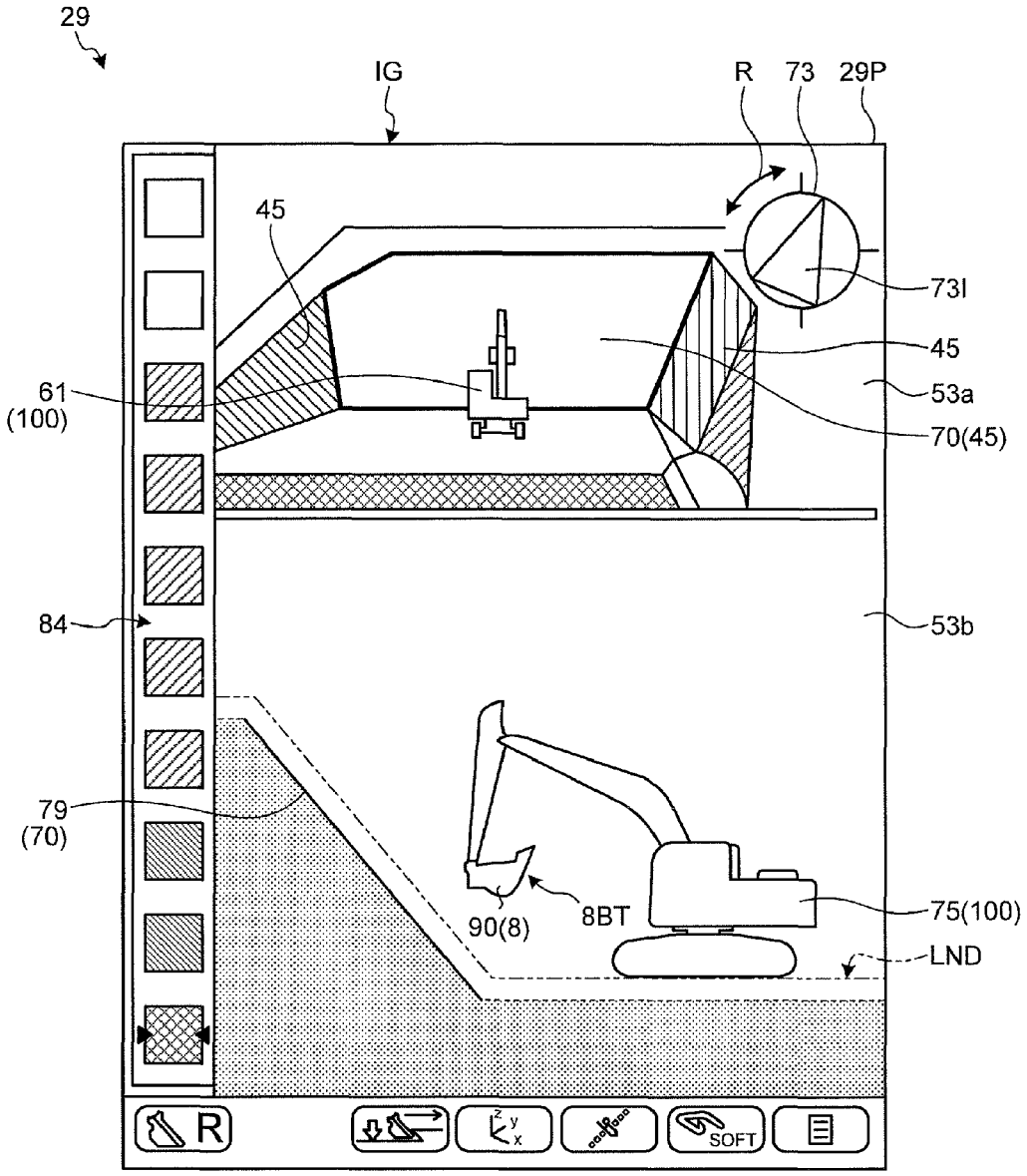
FIG. 3 is a diagram illustrating an example of a guidance image.

FIG. 3 is a diagram illustrating an example of the guidance image IG. In the embodiment, the guidance image IG indicates a positional relationship between the target construction surface 70 and the blade edge 8T of the bucket 8. The guidance image IG is an image for guiding the operator of the excavator 100 on the operation of the working unit 2 so that the ground, which is an example of the construction object, has the same shape as the one indicated by the target construction surface 70.

The guidance image IG is displayed on a screen 29P of the display unit 29. The guidance image IG includes a front view 53*a* and a side view 53*b*. The front view 53*a* indicates a designed surface 45 that includes a designed landform of a construction area, that is, the target construction surface 70, and a current position of the excavator 100. The side view 53*b* indicates a positional relationship between the target construction surface 70 and the excavator 100. The front view 53*a* of the guidance image IG represents the designed landform in a front view by a plurality of triangle polygons. As illustrated in the front view 53*a*, the display controller 28 causes the display unit 29 to display the whole plurality of triangle polygons as the designed surface 45 or the target construction surface 70. FIG. 3 illustrates a state in which the excavator 100 faces a slope when the designed landform is a slope. The front view 53*a* may be a view in which the designed surface 45 that includes a designed landform, that is, the target construction surface 70, and a current position of the excavator 100 are displayed in a three-dimensional form like a bird's eye view.

The target construction surface 70 selected as the target work object from the plurality of designed surfaces 45 is displayed in a different color from other designed surfaces 45. For example, in a case where the touch panel is used for the display unit 29, the operator of the excavator 100 can select the target construction surface 70 by touching a place that corresponds to the target construction surface 70 among the plurality of designed surfaces 45 displayed on the screen 29P. In the front view 53*a* of FIG. 3, the current position of the excavator 100 is indicated by an icon 61 of the excavator 100 in a back view. However, the current position may be indicated by other symbols. The front view 53*a* includes information for causing the excavator 100 to face the target construction surface 70. The information for causing the excavator 100 to face the target construction surface 70 is displayed as a facing compass 73 based on a result of calculating the positional relationship between the excavator 100 (the blade edge 8T of the bucket 8) and the target construction surface 100. The facing compass 73 is posture information such as a picture or an icon in which an indicator 731 that has an arrow shape rotates in a direction indicated by an arrow RD, and guides a direction facing the target construction surface 70 and a direction in which the excavator 100 is to be swung.

The guidance image IG includes an image that indicates the positional relationship between the target construction surface 70 and the blade edge 8T of the bucket 8, and distance information that indicates a distance between the target construction surface 70 and the blade edge 8T of the bucket 8. In the embodiment, the side view 53*b* includes a target construction surface line 79, an icon 75 of the excavator 100 viewed from the side, an icon 90 of the bucket 8 viewed from the side, and a ground LND in contact with the excavator 100. The target construction surface line 79 indicates a cross section of the target construction surface 70. The target construction surface line 79 is obtained by calculating an intersection line of a plane parallel to the center of the working unit passing through the current position of the blade edge 8T of the bucket 8 and the designed surface 45. The intersection line is determined by the processing unit 28P of the display controller 28. The plane parallel to the center of the working unit is, for example, a plane that passes through the center of the bucket pin 15 in the width direction illustrated in FIG. 1, and is perpendicular to the direction in which the bucket pin 15 extends.

In the side view 53*b*, the distance information that indicates the distance between the target construction surface 70 and the blade edge 8T of the bucket 8 includes graphic information 84. The distance between the target construction surface 70 and the blade edge 8T of the bucket 8 is, for example, a distance between a point at which a line drawn down from the blade edge 8T toward the target construction surface 70 in the vertical direction (the direction of gravity) intersects with the target construction surface 70, and the blade edge 8T. Alternatively, the distance between the target construction surface 70 and the blade edge 8T of the bucket 8 may be a distance between an intersection point generated when a perpendicular is drawn down from the blade edge 8T to the target construction surface 70, and the blade edge 8T.

The graphic information 84 is information that graphically indicates the distance between the blade edge 8T of the bucket 8 and the target construction surface 70. The graphic information 84 is a guidance index for indicating the position of the blade edge 8T of the bucket 8. A numerical distance between the target construction surface line 79 and the excavator 100 (not illustrated) for indicating a positional relationship therebetween may be displayed on the guidance image IG. The operator of the excavator 100 can easily excavate the ground so that the current landform becomes the designed landform (target construction surface 70) by moving the blade edge 8T of the bucket 8 along the target construction surface line 79.

The display controller 28 illustrated in FIG. 2, as described above, generates drawing information to draw the side of the bucket 8 using information of the shape and size of the bucket 8. The bucket 8 displayed on the display unit 29 based on the drawing information is a side view image. To view the side of the bucket 8 is to view the bucket 8 from a direction in which the bucket pin 15 extends. The side view of the bucket 8 includes an image that indicates a bottom surface 8BT of the bucket 8.

Figure 4:
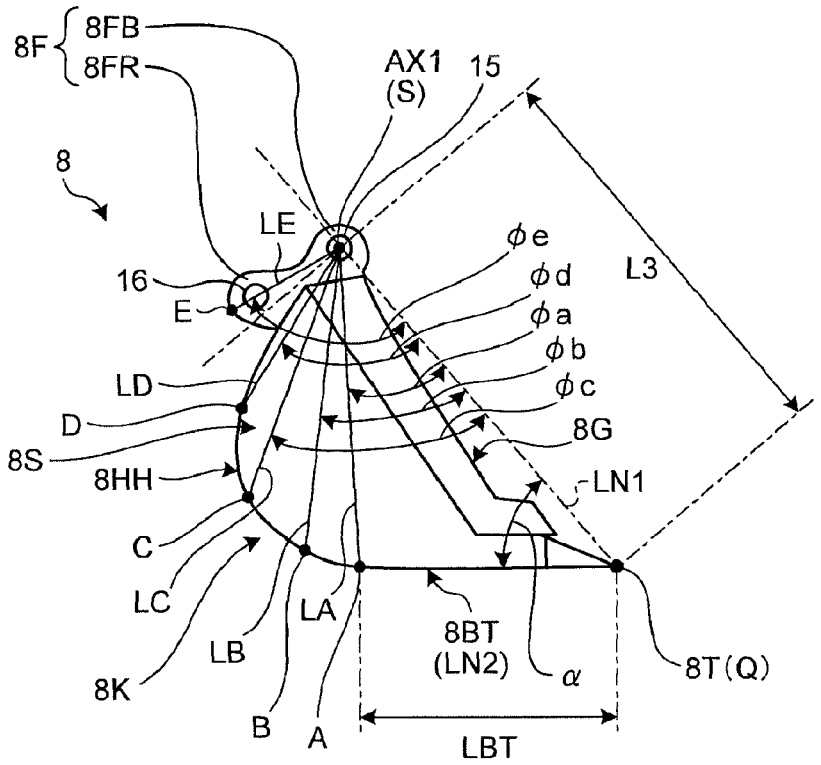
FIG. 4 is a side view for describing information of shape and size of a bucket.

FIG. 4 is a side view for describing the information of the shape and size of the bucket 8. In the bucket 8, an outer side 8K which is from the bucket pin 15 to the blade edge 8T, that is, a portion opposed to an opening portion 8G protrudes. The bucket 8 has a pair of side surfaces 8S provided to oppose each other in the width direction, and the outer side 8K of the bucket 8 is bonded to the pair of side surfaces 8S. The width direction of the bucket 8 is also a direction in which the bucket pin 15 extends.

The bucket 8 is attached to the arm 7 illustrated in FIG. 1 via an attaching portion 8F and the bucket pin 15. The bucket 8 is also attached to the bucket cylinder 12 illustrated in FIG. 1 via the attaching portion 8F, the link 17, and the link pin 16. The attaching portion 8F is a portion where the bucket 8 is coupled to the working unit 2 in order to cause the bucket 8 to turn about the bucket pin 15. More specifically, the attaching portion 8F is a portion that couples the bucket cylinder 12 to the bucket 8, and is also a portion that couples the arm 7 of the working unit 2 to the bucket 8, and a first portion where the link pin 16 is attached. A portion of the attaching portion 8F on the side of the bucket pin 15 is referred to as an arm side 8FB, and another portion thereof on the side of the link pin 16 is referred to as a link side 8FR.

The outer side 8K of the bucket 8 has a curved surface portion 8HH and the bottom surface 8BT. The curved surface portion 8HH is a portion between the attaching portion 8F and the blade edge 8T, and formed of a curved surface. The bottom surface 8BT is a portion between the blade edge 8T and the attaching portion 8F, and formed of a flat surface. Therefore, when the bucket 8 is viewed from the side surface 8S, the bottom surface 8BT is a straight line. A boundary between the bottom surface 8BT and the curved surface portion 8HH is a position A. The curved surface portion 8HH is from the bucket pin 15 to the position A. The bottom surface 8BT is from the blade edge 8T to the position A. The position A is at the rear side of the bucket 8, that is, on the side of the curved surface portion 8HH, and is a rear side end of the bottom surface 8BT. The position A is a position of the bucket rear side end at the bottom surface 8BT.

A center axis line AX1 of the bucket pin 15 is a center of turn of the bucket 8. In the side view of the bucket 8, the blade edge 8T and the bucket pin 15 of the bucket 8, more specifically, a straight line that connects the blade edge 8T and the center axis line AX1 of the bucket pin 15 is referred to as a first straight line LN1. Additionally, in the side view of the bucket 8, a straight line that indicates the bottom surface 8BT of the bucket 8 is appropriately referred to as a second straight line LN2.

The storage unit 28M of the display controller 28 illustrated in FIG. 2 stores the information that represents the shape and size of the bucket 8. The information that represents the shape and size of the bucket 8, in the side view of the bucket 8, includes a bucket length L3, an angle α, a position Q, a position S, and at least one position on the outer side 8K of the bucket 8 between the attaching portion OF and the blade edge 8T. In the embodiment, the position on the outer side 8K of the bucket 8 refers to a position on the surface of the outer side 8K.

In the side view of the bucket 8, the bucket length L3 is a distance between the blade edge 8T of the bucket 8 and the bucket pin 15, more specifically, a distance between the blade edge 8T and the center axis line AX1 of the bucket pin 15 (corresponds to the first straight line LN1). The bucket length L3 is a straight line that connects the blade edge 8T and the bucket pin 15. In the side view of the bucket 8, the angle α is an angle formed by the first straight line LN1 and the second straight line LN2. In the side view of the bucket 8, the position Q is a position of the blade edge 8T of the bucket 8. Hereinafter, the position of the blade edge 8T is appropriately referred to as a blade edge position Q. In the side view of the bucket 8, the position S is a position of the bucket pin 15, more specifically, a position of the center axis line AX1 of the bucket pin 15. At least one position on the outer side 8K of the bucket 8, between the attaching portion 8F and the blade edge 8T, is at least one of positions A, B, C, and D in the example illustrated in FIG. 4. The position on the outer side 8K of the bucket 8, between the attaching portion 8F and the blade edge 8T, is not limited to four, and may be five or more, or three or less.

The angles φa, φb, φc, φd, and φe illustrated in FIG. 4 are angles formed by the first straight line LN1 and respective straight lines that connect the center axis line AX1 and the positions A, B, C, D, and E. The angle φa is an angle formed by a straight line that connects the blade edge 8T of the bucket 8 and the bucket pin 15 and a straight line from the bucket pin 15 to the position A of the bucket rear side end at the bottom surface 8BT. Lengths LA, LB, LC, LD, and LE are lengths of straight lines that connect the center axis line AX1 and the respective positions A, B, C, D, and E. The positions A, B, C, D, and E are positions on the outer side 8K of the bucket 8. Therefore, it is possible to grasp the outline of a shape of the outer side 8K of the bucket 8 from the positions A, B, C, D, and E. The positions B, C, and D are positions on the outer side 8K at the curved surface portion 8HH of the bucket 8, and the position E is a position on the link side 8FR of the attaching portion 8F. The bucket length L3, the lengths LA, LB, LC, LD, and LE, and the angles φa, φb, φc, φd, and φe are also the information that represents the shape and size of the bucket 8.

From the information of the shape and size of the bucket 8, a length LBT of the bottom surface 8BT in the side view of the bucket 8, that is, the length LBT of the second straight line LN2, and the angle α are obtained. The length LBT of the bottom surface 8BT is determined by Formula (1), and the angle α is determined by Formula (2). The angle φa is an angle formed by the first straight line LN1 and a straight line that connects the center axis line AX1 and the position A. The length LA is a length of a straight line that connects the bucket pin 15, specifically the center axis line AX1, and the position A in the side view of the bucket 8. The length LA is a length of a straight line, in the side view of the bucket 8, that connects the bucket pin 15 and the position A of the bucket rear side end at the bottom surface 8BT. The angle α can be determined by the angle φa. Therefore, the angle α may not be included in the information that represents the shape and size of the bucket 8.

$$\mathrm{LBT}=\sqrt{\{L3^2+LA^2-2\times L3\times LA\times\cos(\phi a)\}} \quad (1)$$

$$\alpha=\cos^{-1}\{(L3^2+\mathrm{LBT}^2-LA^2)/(2\times L3\times\mathrm{LBT})\} \quad (2)$$

Figure 5:
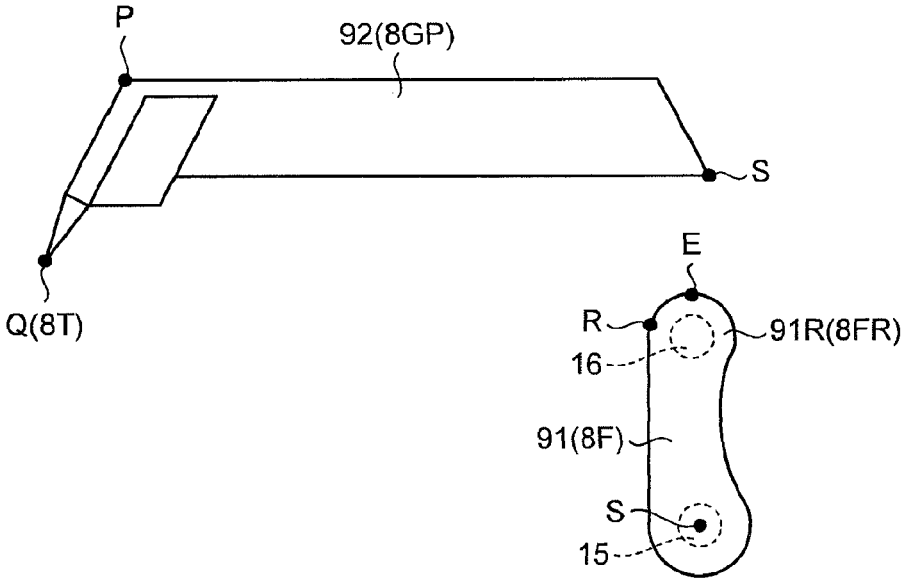
FIG. 5 is a diagram illustrating first drawing information of a first portion and second drawing information of a second portion.

FIG. 5 is a diagram that illustrates first drawing information 91 of a first portion 8F, and second drawing information 92 of a second portion 8GP. The display controller 28 generates drawing information to draw the image of the bucket 8 when viewed from the side using the first drawing information 91 and the second drawing information 92. In this case, for example, the display controller 28 deforms the first drawing information 91 and the second drawing information 92 to conform to the information of the shape and size of the bucket 8 currently attached to the working unit 2 of the excavator 100. Next, the display controller 28 generates information of a figure that passes through at least one position on the outer side 8K of the bucket 8 between the bucket pin 15 and the blade edge 8T, and the position S of the bucket pin 15. The display controller 28 uses the deformed first drawing information 91 and second drawing information 92, and information of the main body portion as the drawing information for displaying an image of the bucket 8 when viewed from the side.

The first drawing information 91 is information for displaying an image of the first portion 8F on the display unit 29, and is a set of a plurality of pixels. The second drawing information 92 is information for displaying an image of the second portion 8GP on the display unit 29, and is a set of a plurality of pixels. The second portion 8GP is from the first portion 8F to the blade edge 8T of the bucket 8, and a portion that occupies a predetermined area from the opening portion 8G of the bucket 8 toward the inner side of the bucket 8. The second portion 8GP includes a part of the side surface 8S, and the blade 8B.

In the first drawing information 91, a position R as a reference is set in addition to the position E, and the position S of the bucket pin 15. The position R is a position on the side of a portion 94R that corresponds to the link side 8FR of the attaching portion 8F, and on the side of the second drawing information 92. In the second drawing information 92, a position P as a reference is set in addition to the blade edge position Q, and the position S of the bucket pin 15. The position P is a position on the side of the blade 8B, which is the inner side of the bucket 8.

In the embodiment, the first drawing information 91 and the second drawing information 92 are elements for reference. The display controller 28 generates the drawing information of the bucket 8 by deforming or rotating the first drawing information 91 and the second drawing information 92 using the information that represents the shape and size of the bucket 8 currently attached to the working unit 2 of the excavator 100. Next, a method of generating drawing information to draw the image of the bucket 8 viewed from the side and displaying the drawing information on the display unit 29, that is, the display method according to the embodiment will be described. The display method according to the embodiment is executed by the display controller 28.

Figure 6:
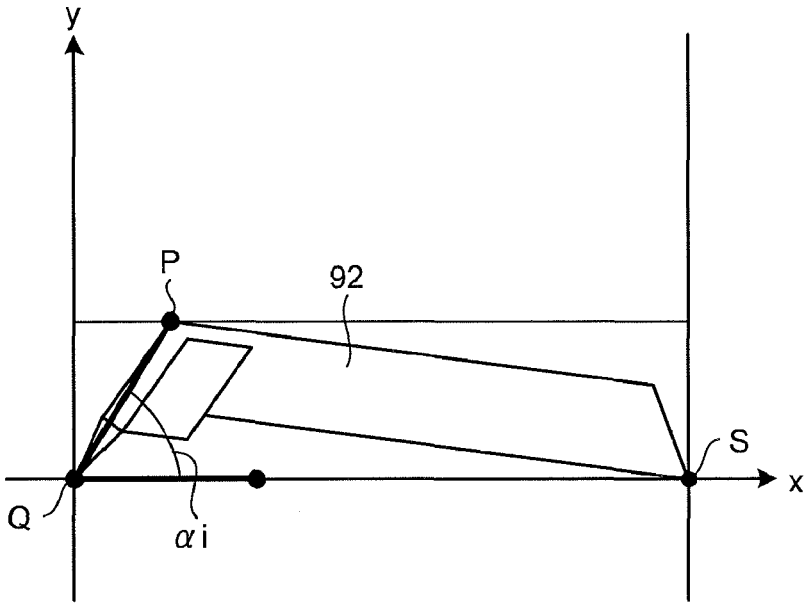
FIG. 6 is a diagram for describing an example of processing of a display method according to the embodiment.

FIGS. 6 to 11 are diagrams for describing a processing example of the display method according to the embodiment. In FIGS. 6 to 11, the first straight line LN1 that connects the blade edge position Q of the second drawing information 92 and the position S of the bucket pin 15 is an x-axis, and an axis perpendicular to the first straight line LN1 is a y-axis. FIG. 6 illustrates an image of the second drawing information 92. An angle formed by the first straight line LN1 and a straight line that connects the blade edge position Q and the position P is ai.

When the display method according to the embodiment is executed, a command that specifies the bucket 8 attached to the working unit 2 is input by the input device 281 illustrated in FIG. 2. Then, the processing unit 28P of the display controller 28 reads information that represents a shape and a size of the specified bucket 8 from the storage unit 28M. In the embodiment, the information that represents the shape and size of the bucket 8 includes at least the positions A, B, C, D, and E, the blade edge position Q, the position S of the bucket pin 15, and the bucket length L3. In addition, the length LA and the angle $\phi a$ are included in the information that represents the shape and size of the bucket 8.

Figure 7:
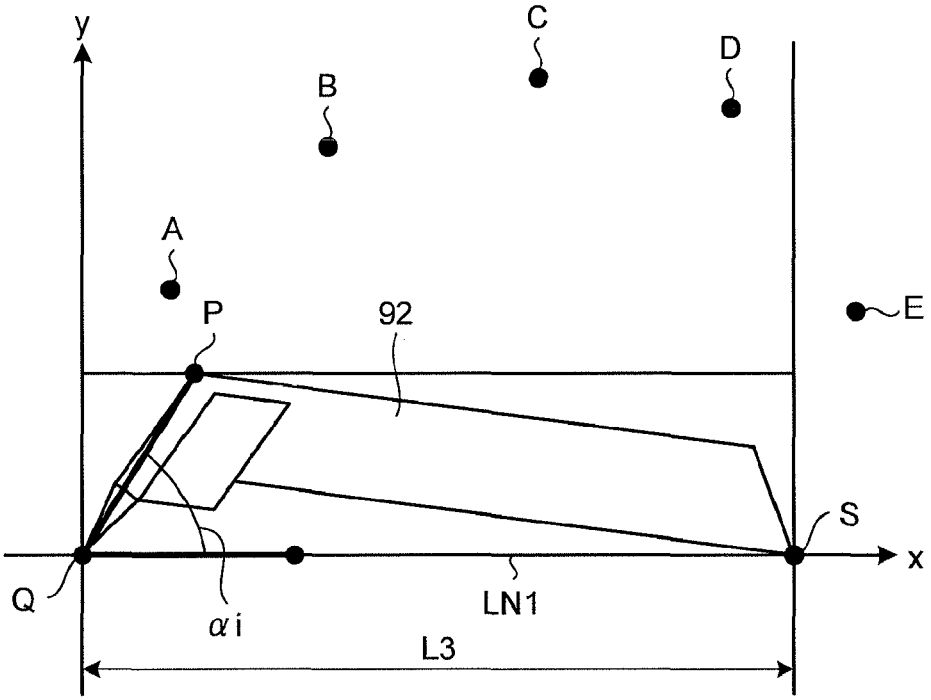
FIG. 7 is a diagram for describing an example of processing of the display method according to the embodiment.

The processing unit 28P, as illustrated in FIG. 7, changes the size of the second drawing information 92 while maintaining an aspect ratio of the second drawing information 92 so that a distance between the blade edge position Q and the position S of the bucket pin 15 in the second drawing information 92 becomes the number of pixels corresponding to the read bucket length L3. Next, the processing unit 28P obtains the angle $\alpha$ of the specified bucket 8 from the bucket length L3, the length LA, and the angle $\phi a$, and from the Formulas (1) and (2). The obtained angle $\alpha$ is described as the angle $\alpha r$ in the following description.

Figure 8:
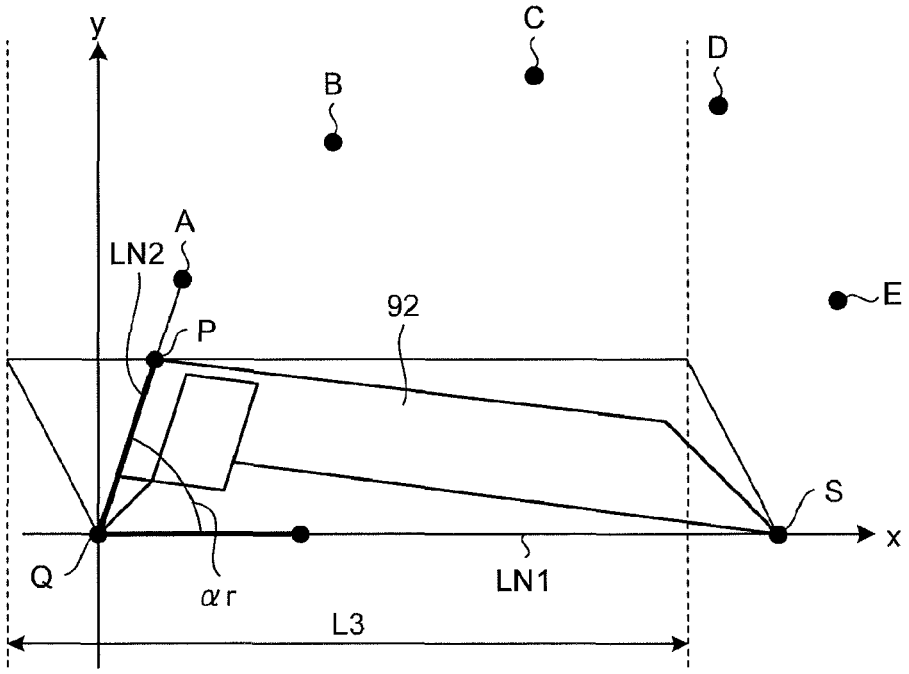
FIG. 8 is a diagram for describing an example of processing of the display method according to the embodiment.

After obtaining the angle $\alpha r$, the processing unit 28P changes the second drawing information 92. In this case, for example, the processing unit 28P, as illustrated in FIG. 8, moves the whole second drawing information 92 in a direction parallel to the x axis and deforms the second drawing information so that the angle $\alpha i$, which is formed by the first straight line LN1 and a straight line that connects the blade edge position Q and the position P (corresponds to the second straight line LN2), becomes $\alpha r$. At this time, the processing unit 28P deforms the whole second drawing information 92 while keeping the blade edge position Q and the position S of the bucket pin 15 at the same positions, and keeping the position P in the y coordinate at the same position. After the deformation, when the angle formed by the first straight line LN1 and the straight line that connects the blade edge position Q and the position P becomes $\alpha r$, the blade edge position Q, the position P, and the position A are aligned on a same straight line. A straight line that connects the blade edge position Q and the position A corresponds to the second straight line LN2.

Figure 9:
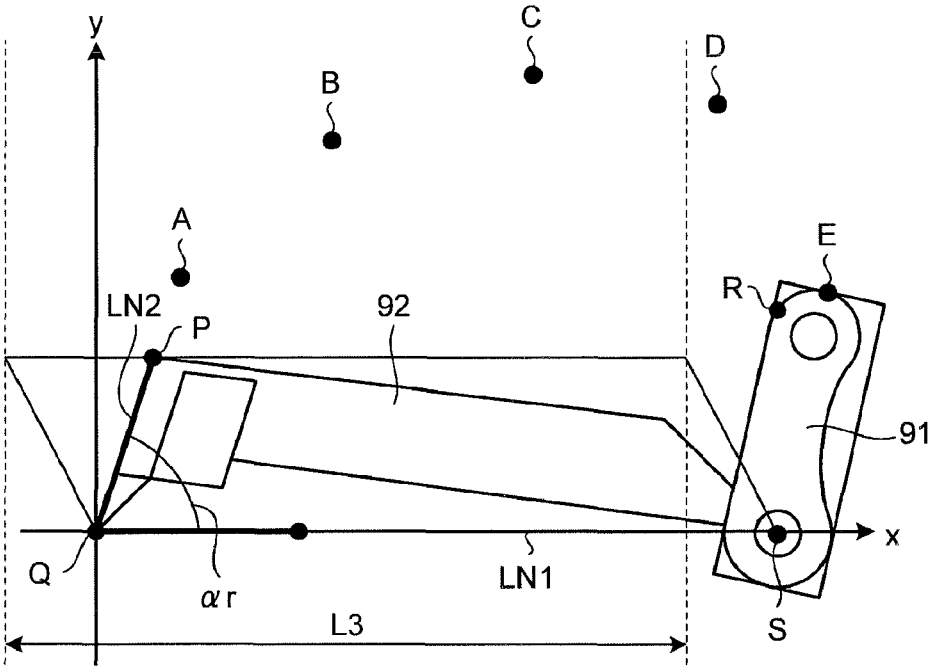
FIG. 9 is a diagram for describing an example of processing of the display method according to the embodiment.

As illustrated in FIG. 9, the processing unit 28P causes the position S of the bucket pin 15 of the first drawing information 91 to match the position S of the bucket pin 15 of the second drawing information 92. Then, the processing unit 28P changes the first drawing information 91. Also in changing the first drawing information 91, the size of the first drawing information 91 is changed while the aspect ratio of the first drawing information 91 is maintained. In this case, the processing unit 28P changes the size for displaying on the display unit 29 while rotating the first drawing information 91 so that the position E of the first drawing information 91 becomes a coordinate that corresponds to the position E of the specified bucket 8. By the processing so far, the blade edge position Q, the position S of the bucket pin 15, the bucket length L3, and the angle $\alpha r$ formed by the first straight line LN1 and the second straight line LN2 in the first drawing information 91 and the second drawing information 92 become the same values as those of the bucket 8 attached to the working unit 2.

Figure 10:
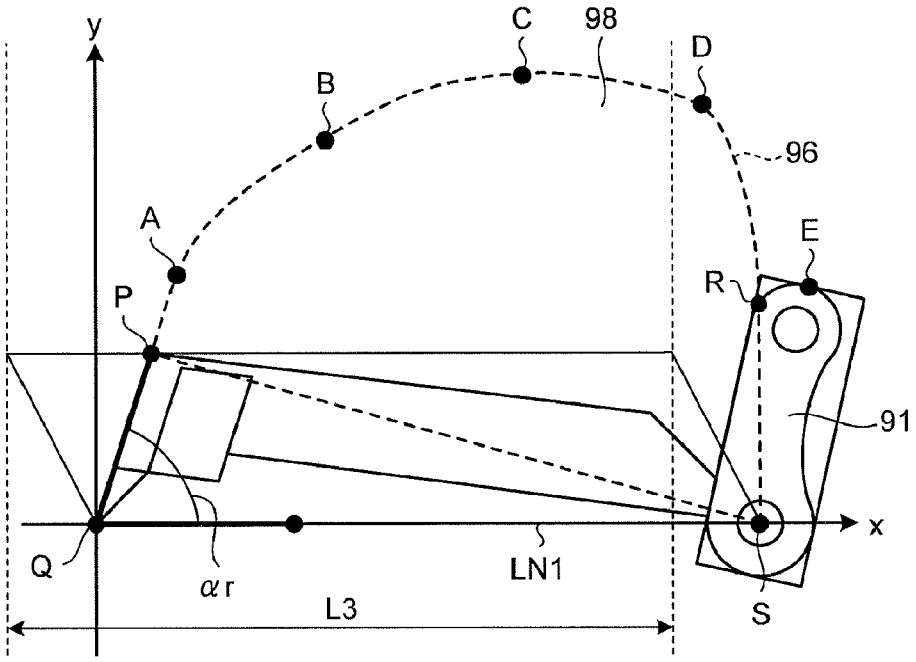
FIG. 10 is a diagram for describing an example of processing of the display method according to the embodiment.
Figure 11:
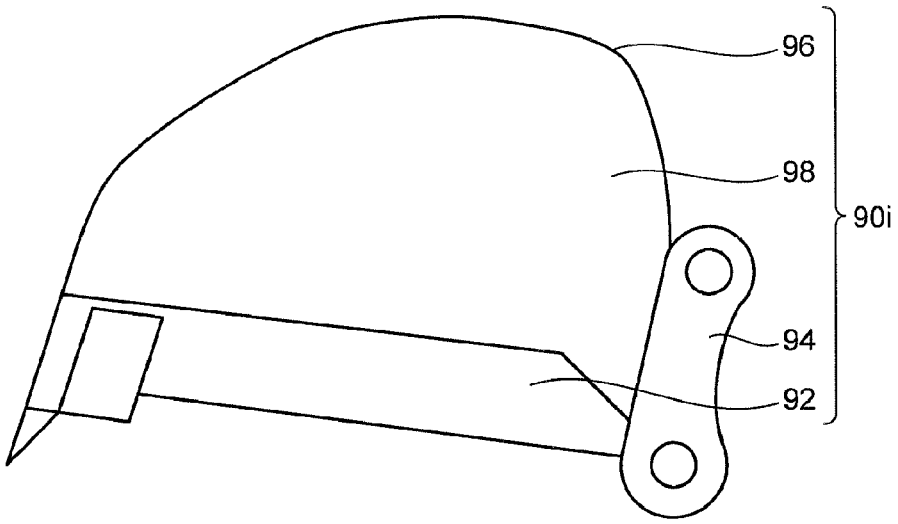
FIG. 11 is a diagram for describing an example of processing of the display method according to the embodiment.

As illustrated in FIG. 10, the processing unit 28P generates information of a FIG. 96 that passes through the positions P, A, B, C, D, R, and S. In the embodiment, the FIG. 96 is a closed curve line that passes through the positions P, A, B, C, D, R, and S. As illustrated in FIG. 11, the processing unit 28P uses pixels on and inside the FIG. 96, which is the closed curve line, as third drawing information 98. The third drawing information 98 may include only a shape (closed curve line) of the FIG. 96 without including the pixels inside the FIG. 96. As described above, the processing unit 28P obtains the third drawing information 98 by generating the FIG. 96. The processing unit 28P combines the first drawing information 91, the second drawing information 92, and the third drawing information 98, and generates drawing information 90*i* (refer to FIG. 11) to draw the image of the bucket 8 viewed from the side. The drawing information 90*i* becomes an icon 90 illustrated in FIG. 3 when displayed on the display unit 29. By such processing, the processing unit 28P generates the drawing information 90*i*. The generated drawing information 90*i* is stored in the storage unit 28M.

Figure 12:
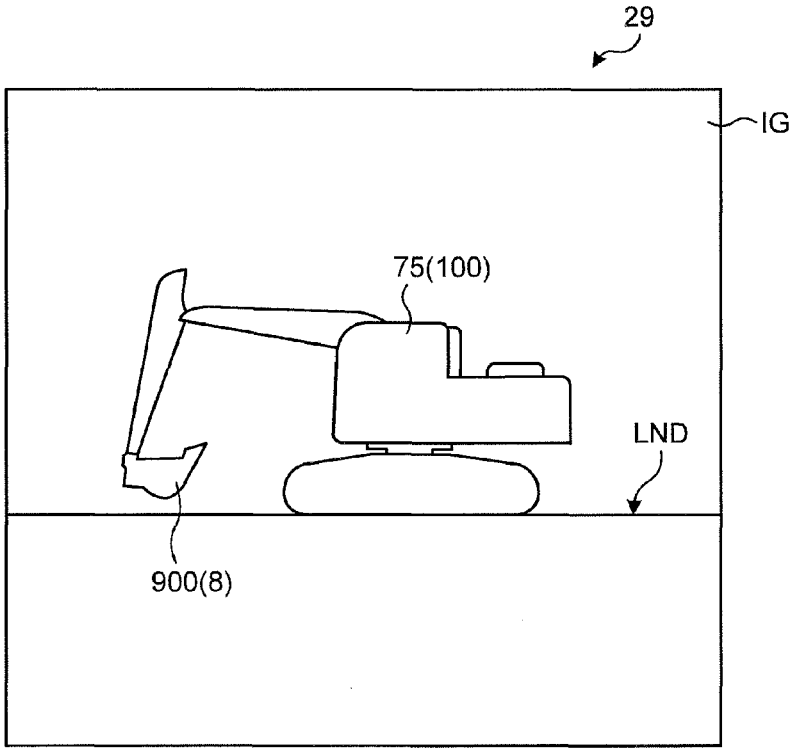
FIG. 12 is a diagram illustrating a display example of the bucket according to a comparative example.
Figure 13:
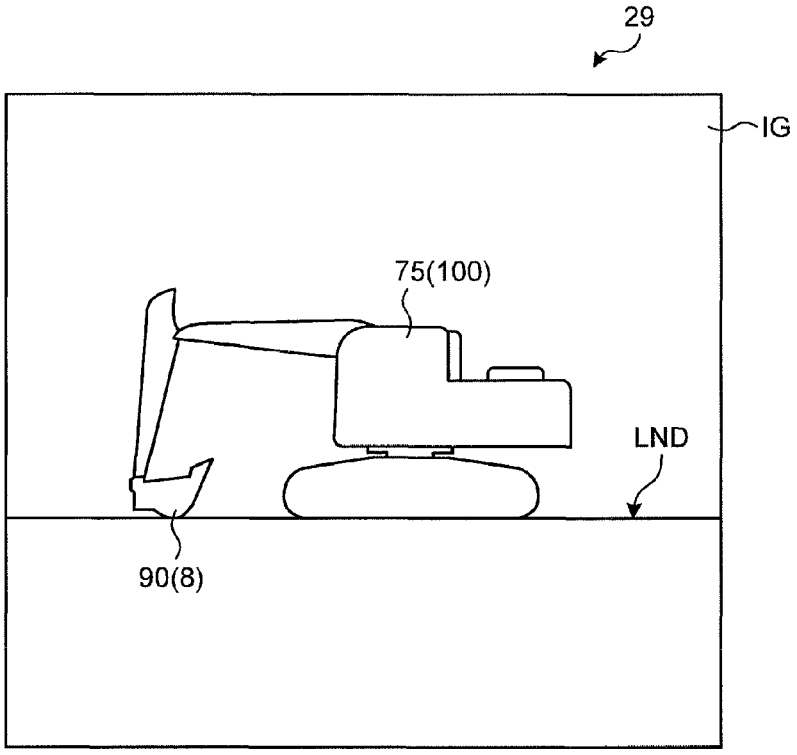
FIG. 13 is a diagram illustrating a display example of the bucket by a display system according to the embodiment and by the display method according to the embodiment.

FIG. 12 is a diagram illustrating a display example of the bucket 8 according to a comparative example. FIG. 13 is a diagram illustrating a display example of the bucket 8 by the display system 102 according to the embodiment, and by the display method according to the embodiment. In both FIGS. 12 and 13, the guidance image IG is displayed on the display unit 29. In the guidance image IG, the position of the excavator 100 in the global coordinate system and the current landform or the designed landform are displayed. Therefore, a relationship between the bucket 8 of the working unit 2 and the current landform is displayed on the display unit 29.

In the embodiment, the ground LND displayed in the guidance image IG may be one of or all of a line that indicates the cross-section of the target construction surface 70 which indicates the target shape of the construction object (the target construction surface line 79), a ground-contacting surface of the excavator 100 which is not the construction object, and an image that indicates the cross-section of the surrounding ground (for example, a line image). FIGS. 12 and 13 are examples of displaying the images that indicate the cross-section of the ground LND (ground plane) in contact with the excavator 100, that is, the line images in this example.

The comparative example displays an icon 900, which is an image of the bucket 8 viewed from the side, on the display unit 29 based on drawing information generated by only the bucket length L3 of the bucket 8, the angle α, and a length of a portion that corresponds to a straight line of the bottom surface 8BT. There is a case where the icon 900 cannot represent the shape of the bucket 8. Therefore, for example, when the excavator 100 brings the bucket 8 into contact with the ground LND, although the operator, as illustrated in FIG. 12, operates the operating device 25 and brings the bucket 8 into contact with the ground LND while visually observing the working unit 2 including the bucket 8, there is a case where the icon 900 is displayed as apart from the ground LND in the guidance image IG.

There is a possibility that the display of the guidance image IG and the actual state of the working unit 2 do not match, and the operator of the excavator 100 feels discomfort. Therefore, in the comparative example illustrated in FIG. 12, information about the outer side 8K of the bucket 8, which is necessary information for generating the drawing information to display the side view of the bucket 8, needs to be optimized.

According to the display system 102 and the display method of the embodiment, which have been described in the embodiment, it is possible to display the icon 90, which is an image of the bucket 8 viewed from the side, on the display unit 29 based on the drawing information that has been properly generated using the information of the shape and size of the bucket 8. As described above, the icon 90 is properly displayed using the information of the shape and size of the bucket 8. Therefore, for example, in a case where the bucket 8 of the excavator 100 is brought into contact with the ground LND, the state in which the icon 90 is brought into contact with the ground LND is displayed in the guidance image IG, as illustrated in FIG. 13. Since the display of the guidance image IG and the actual state of the working unit 2 match, the operator of the excavator 100 does not feel discomfort, and can grasp the actual state of the working unit 2 from the guidance image IG.

In the embodiment, it is preferable that the position on the outer side 8K of the bucket 8, between the attaching portion 8F and the blade edge 8T, include a position at a farthest distance from the opening portion 8G in the side view of the bucket 8. The position at the farthest distance from the opening portion 8G is a portion of the outer side 8K including an intersection point Xb in a case where a distance between an intersection point Xa and the intersection point Xb is the longest. At a cross-section of the bucket 8 perpendicular to the center axis line AX1, the intersection point Xa is an intersection point of an imaginary line IL perpendicular to the first straight line LN1 and an opening end of the bucket 8 that defines the opening portion 8G, and the intersection point Xb is an intersection point of the imaginary line IL and the outer side 8K of the bucket 8. According to this, the display controller 28 can generate the FIG. 96 that passes through a portion with a largest depth of the bucket 8, that is, with a largest distance from the opening portion 8G of the bucket 8. As a result, the display controller 28 generates the drawing information 90 that uses a FIG. 96*b* so that a proper display of the image of the bucket 8 can be implemented.

In a case where a position on the outer side 8K of the bucket 8, between the attaching portion 8F and the blade edge 8T, is one, it is preferable that the position be a position at the farthest distance from the opening portion 8G in the side view of the bucket 8. Similar to that described above, the position at the farthest distance from the opening portion 8G is a portion of the outer side 8K including the intersection point Xb in a case where a distance between the intersection point Xa and the intersection point Xb is the longest. According to this, the display controller 28 can generate the FIG. 96 that passes through a portion with a largest depth of the bucket 8, that is, with a largest distance from the opening portion 8G of the bucket 8. As a result, the display controller 28 generates the drawing information 90 that uses a FIG. 96*b* so that a proper display of the image of the bucket 8 can be implemented.

Figure 14:
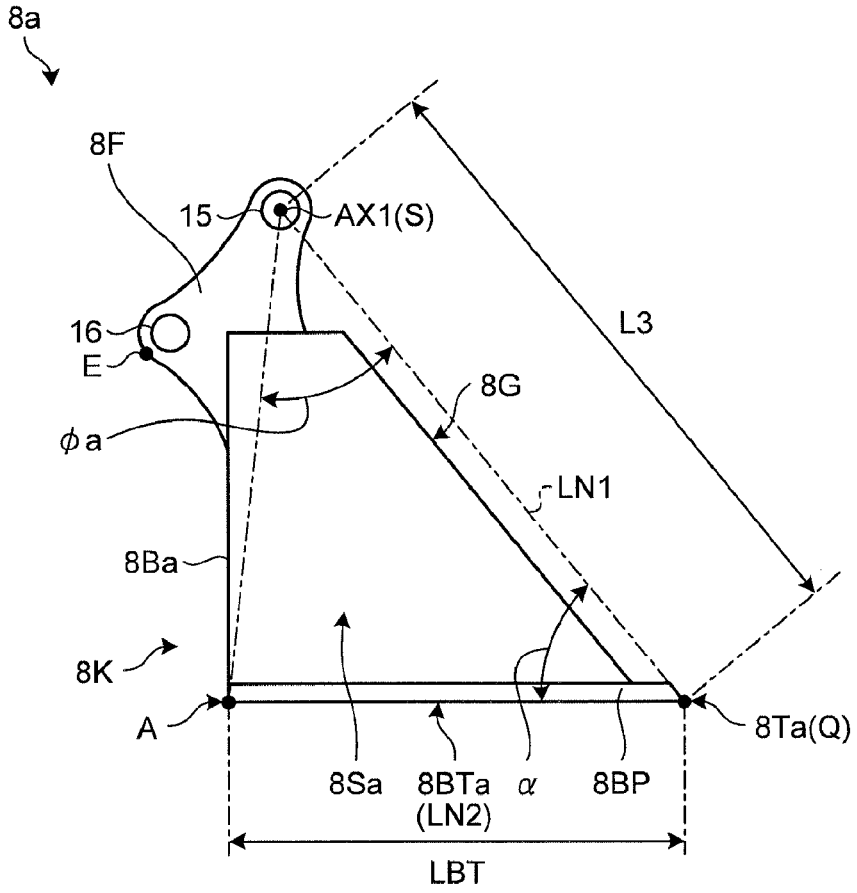
FIG. 14 is a side view illustrating a bucket for slope construction.

FIG. 14 is a side view illustrating a bucket 8*a* for slope construction. In the bucket 8*a* for slope construction illustrated in FIG. 14, a bottom plate 8BP, which is one flat plate, is provided in a width direction of the bucket 8*a*. The bottom plate 8BP is bonded to a pair of side surfaces 8Sa arranged to oppose each other. The bucket 8*a* for slope construction has a rear plate 8Ba bonded to an end portion of the bottom plate 8BP (an end portion opposite to the blade edge 8Ta) and end portions of the side surfaces 8Sa (end portions opposite to the opening side of the bucket 8*a*). The bucket 8*a* for slope construction is attached to the arm 17 of the working unit 2 via the attaching portion 8F and the bucket pin 15, and is attached to the bucket cylinder 12 illustrated in FIG. 1 via the attaching portion 8F, and the link 17 and the link pin 16 illustrated in FIG. 1.

In the bucket 8*a* for slope construction, an entire outer surface of the bottom plate 8BP becomes a bottom surface 8BTa. An end portion of the bottom plate 8BP on the side of the rear plate 8Ba is a position A which is a boundary between the bottom surface 8BTa and a portion other than the bottom surface 8BTa. The position A is a position at the farthest distance from an opening portion 8G of the bucket 8*a* for slope construction. A length from a blade edge 8Ta to the position A is also a length LBT of the bottom surface 8BTa in the bucket 8*a* for slope construction. Also for the bucket 8*a* for slope construction, similar to the bucket 8 illustrated in FIG. 4, the length LBT of the bottom surface 8BTa, that is, a length LBT of a second straight line LN2, and an angle α formed by the first straight line LN1 and the second straight line LN2 are obtained using the Formulas (1) and (2).

Figure 15:
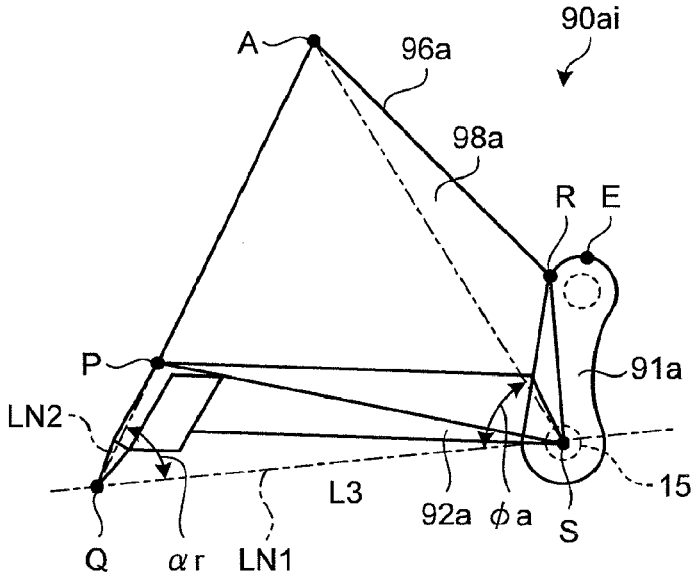
FIG. 15 is a diagram illustrating drawing information corresponding to the bucket for slope processing illustrated in FIG. 14.

FIG. 15 is a diagram illustrating drawing information 90*ai* corresponding to the bucket 8*a* for slope processing illustrated in FIG. 14. The processing unit 28P of the display controller 28, similar to the bucket 8, generates the drawing information 90*ai* to draw an image of the bucket 8*a* for slope processing viewed from the side using the information of the shape and size of the bucket 8*a* for slope processing. The display unit 29 illustrated in FIG. 2 displays the image of the bucket 8*a* for slope processing viewed from the side based on the drawing information 90*ai*.

The drawing information 90*ai* is generated by the processing unit 28P combining first drawing information 91*a*, second drawing information 92*a*, and third drawing information 98*a*. The second drawing information 92*a* is deformed so that an angle formed by the first straight line LN1 and the second straight line LN2 becomes the same as the angle $\alpha r$ formed by the first straight line LN1 and the second straight line LN2 of the bucket 8*a* for slope construction attached to the working unit 2. This processing of deformation is the same as that described above.

The third drawing information 98*a* is a set of pixels on and inside a FIG. 96*a* that passes through the position S of the bucket pin 15, the position R, the position A, and the position P. In the bucket 8*a* for slope construction, the position A is used as a position on the outer side 8K of the bucket 8*a* between the attaching portion OF and the blade edge 8T. The third drawing information 98*a* may include only an outline that indicates the shape of the FIG. 96 without including the pixels inside the FIG. 96. The FIG. 96*a* does not have to pass through at least one of the position R and the position P. That is, the FIG. 96*a* should pass through at least the position Q, the position A, and the position S.

Thus, also for the bucket 8*a* for slope construction, similar to the ordinary bucket 8, the drawing information 90*ai* is generated. The bucket 8*a* for slope construction is also generated using the information of the shape and size of the bucket 8*a* for slope construction. Therefore, the shape of the bucket 8*a* for slope construction that is actually attached to the working unit 2 is represented on the screen of the display unit 29. As a result, since the display of the guidance image IG and the actual state of the working unit 2 match, the operator of the excavator 100 does not feel discomfort, and can grasp the actual state of the working unit 2 from the guidance image IG.

Modified Example

Figure 16:
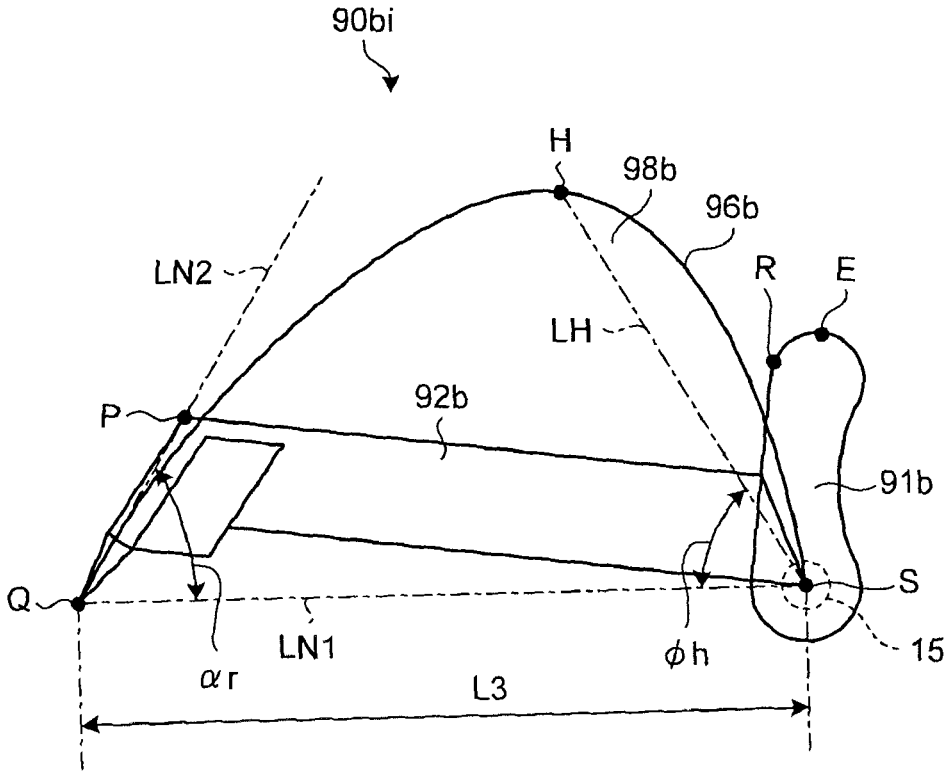
FIG. 16 is a diagram illustrating drawing information according to a modified example of the embodiment.

FIG. 16 is a diagram illustrating drawing information 90*bi* according to a modified example of the embodiment. In the modified example, processing of changing at least one of size and posture of first drawing information 91*b*, and processing of changing at least one of size and posture of second drawing information 92*b* are the same as that in the first drawing information 91 and the second drawing information 92 described above. The processing unit 28P of the display controller 28 generates information of a FIG. 96*b* that passes through the blade edge position Q, the predetermined position H at the outer side 8K of the bucket 8 illustrated in FIG. 4, and the position S of the bucket pin 15 in order to generate third drawing information 98*b*. The FIG. 96*b* may be a quadratic curve, a cubic curve, a hyperbola or the like that passes through the positions Q, H, and S. In the modified example, a straight line that passes through the position S of the bucket pin 15 and the predetermined position H at the outer side of the bucket 8 is referred to as a third straight line SH.

The display controller 28, including the generation unit, can generate the FIG. 96*b* using the information of the shape and size of the bucket 8 including at least the distance between the blade edge 8T of the bucket 8 and the bucket pin 15 that attaches the bucket 8 to the working unit 2, the distance LH between the bucket pin 15 and the predetermined position H at the outer side 8K of the bucket 8, and an angle $\phi h$ formed by the first straight line LN1 that connects the blade edge 8T of the bucket 8 and the bucket pin 15 and the third straight line SH. The display controller 28 can generate the drawing information to draw the image of the bucket 8 viewed from the side by calculating the Formula (1) and the Formula (2) based on the information of the shape and size of the bucket 8.

The processing unit 28P uses, as the third drawing information 98*b*, the pixels on the FIG. 96*b* and the pixels of a portion surrounded by the FIG. 96*b* and the first drawing information 91*b* and the second drawing information 92*b*. The processing unit 28P combines the first drawing information 91*b*, the second drawing information 92*b*, and the third drawing information 98*b*, and generates drawing information 90*bi* to draw the image of the bucket 8 viewed from the side. The third drawing information 98*b* may include only an outline that indicates the shape of the FIG. 96*b* without including the pixels inside the FIG. 96*b*.

In the embodiment described above, as illustrated in FIG. 10, information of the FIG. 96 that passes through the positions P, A, B, C, D, R, and S is generated. That is, the FIG. 96 passes through the position R on the first drawing information 91, the position P on the second drawing information 92, and furthermore, passes through a plurality of positions A, B, C, and D at the outer side 8K of the bucket 8. The FIG. 96*b* of the modified example passes through the blade edge position Q, the position S of the bucket pin 15, and at least one predetermined position H at the outer side 8K of the bucket 8 without passing through the position R on the first drawing information 91*b* and the position P on the second drawing information 92*b*. Even in this way, the FIG. 96*b* passes through the predetermined position H at the outer side 8K of the bucket 8. Therefore, by using the drawing information 90*bi*, a shape similar to the bucket 8 that is actually attached to the working unit 2 is represented on the screen of the display unit 29.

As in the third drawing information 98 of the embodiment described above, the FIG. 96 passes through the position R on the first drawing information 91 and the position P on the second drawing information 92 so that an outline of the third drawing information 98 becomes smooth. Therefore, a discomfort to the operator of the excavator 100 can be further reduced. The FIG. 96 may pass through at least one of the position R on the first drawing information 91 and the position P on the second drawing information 92. Also in this case, a portion of the position R or the position P where the FIG. 96 has passed through causes the outline of the third drawing information 98 to become smooth.

It is preferable for the FIG. 96 to pass through the plurality of positions A, B, C, and D at the outer side 8K of the bucket 8 so that an outer shape of the third drawing information 98 becomes similar to that of the actual bucket 8. However, as illustrated in the FIG. 96*b* of the modified example, if the FIG. 96 passes through at least one predetermined position H at the outer side 8K of the bucket 8, the outer shape of the third drawing information 98 becomes closer to that of the actual bucket 8 than the comparative example (refer to FIG. 12) described above.

The predetermined position H at the outer side 8K of the bucket 8 should be at least one position on the outer side 8K of the bucket 8. The display controller 28 can represent the outline of the bucket 8 more accurately by using the plurality of predetermined positions H. In the side view of the bucket 8 illustrated in FIG. 4, it is preferable that the predetermined position H be a position at a farthest distance from the opening portion 8G. In this manner, the display controller 28 can generate the FIG. 96*b* that passes through a portion with a largest depth of the bucket 8, that is, with a largest distance from the opening portion 8G of the bucket 8. As a result, the display controller 28 generates the drawing information 90*bi* that uses the FIG. 96*b* so that a proper display of the image of the bucket 8 can be implemented.

In the embodiment and the modified example, the drawing information to draw an image of the bucket 8 viewed from the side is generated using the information of the shape and size of the bucket 8, and the image of the bucket 8 viewed from the side is displayed on the display unit 29 based on such drawing information. In this way, in the embodiment and the modified example, the shape of the bucket 8 actually attached to the working unit 2 can be represented and displayed on the display unit 29. Therefore, the discomfort to the operator can be reduced. Additionally, in the embodiment and the modified example, information about construction status can be comprehensibly provided to the operator.

In the embodiment and the modified example, the drawing information is generated using the information of the shape and size of the bucket 8. Therefore, it is not necessary to store, in the storage unit 28M of the display controller 28, a plurality of graphic data (image information) that indicates the shape of the bucket, depending on the type of bucket. For this reason, in the embodiment and the modified example, storage capacity for storing the information to generate the drawing information can be reduced when any of the several types of the bucket is displayed on the display unit 29. Therefore, it is possible to reduce a load on hardware resources. Additionally, in the embodiment and the modified example, it is not necessary to store in advance the graphic data (image information) that indicates the shape of the bucket. Therefore, time for creating graphic data (image information) in advance can be saved and, for example, display corresponding to the bucket 8 that has a variety of curved surface portions 8HH can be executed. The information of the shape and size of the bucket 8 is stored in advance in the storage unit or the like of the control device included in the excavator as information of the calibration of the excavator 100. Therefore, in the embodiment and the modified example, there is also an advantage that information the excavator 100 already has can be used.

In the embodiment and the modified example, the image of the bucket 8 viewed from the side is displayed on the display unit 29 in the excavator 100, but it is not limited to this. For example, in a case where the excavator 100 is operated by remote control from a control facility, the image of the bucket 8 viewed from the side may be displayed on a screen of a display device provided on an operating device of the control facility. In this case, a processing device of the control facility may generate drawing information to draw an image of the bucket 8 viewed from the side using the information of the shape and size of the bucket 8. Alternatively, the processing device of the control facility may acquire the drawing information generated by the display controller 28 of the excavator 100 through communication, and may display the image based on the drawing information on the display device of the control facility. The display device of the management device may be a portable terminal device equipped with an image display function.

The present embodiment and the modified example are not limited to the contents described above. The components described above may include components readily conceivable by those skilled in the art, components substantially identical, and so-called equivalents. Additionally, the components described above can be suitably combined. Furthermore, various kinds of omission, replacement, and modification may be made in the components in the scope not departing from the gist of the present embodiment and the modified example.

REFERENCE SIGNS LIST

1 Vehicle main body
2 Working unit
3 Upper swing body
8, 8*a* Bucket
8B Blade
8K Outer side
8HH Curved surface portion
8T, 8Ta Blade edge
8S, 8Sa Side surface
8BP Bottom plate
8BT, 8BTa Bottom surface
8Ba Rear plate
15 Bucket pin
16 Link pin
17 Link
23 Global coordinate calculation unit
25 Operating device
26 Working unit controller
27 Sensor controller
28 Display controller
281 Input device
29 Display unit
45 Designed surface
61, 75, 90, 900 Icon
70 Target construction surface
79 Target construction surface line
90*i*, 90*ai*, 90*bi* Drawing information
91, 91*a*, 91*b* First drawing information
92, 92*a*, 92 Second drawing information
98, 98*a*, 98*b* Third drawing information
100 Excavator
101 Control system
102 Display system
L3 Bucket length
LN1 First straight line
LN2 Second straight line
Q Blade edge position

The invention claimed is:

1. A display system of a work machine that has a working unit with a bucket attached thereto, the display system comprising:

a generation unit that generates drawing information to draw an image of the bucket viewed from a side using information of shape and size of the bucket; and a display unit that displays the image of the bucket viewed from the side and an image that indicates a cross-section of landform based on the drawing information generated by the generation unit, wherein the information of the shape and size of the bucket includes, in the side view of the bucket:

a distance between a blade edge of the bucket and a bucket pin that attaches the bucket to the working unit;

a distance between the bucket pin and a predetermined position at an outer side of the bucket; and an angle formed by a straight line that connects the bucket pin and the blade edge of the bucket and a straight line that connects the bucket pin and the predetermined position, and wherein the generation unit:

changes first drawing information to include a first portion, that couples a bucket cylinder, which drives the bucket, and the arm of the working unit to the bucket, and a second drawing information of second portion which is a portion from the first portion to the blade edge, based on the information of the shape and size of the bucket using the first drawing information and the second drawing information;

obtains third drawing information by generating information of a figure that passes through at least one position on the outer side of the bucket between the first portion and the blade edge; and generates said drawing information using the first drawing information, the second drawing information, and the third drawing information.

2. A display system of a work machine that has a working unit with a bucket attached thereto, the display system comprising:

a generation unit that generates drawing information to draw an image of the bucket viewed from a side using information of shape and size of the bucket; and a display unit that displays the image of the bucket viewed from the side and an image that indicates a cross-section of landform based on the drawing information generated by the generation unit, wherein the information of the shape and size of the bucket includes, in the side view of the bucket:

a distance between a blade edge of the bucket and a bucket pin that attaches the bucket to the working unit;

an angle formed by a straight line that connects the blade edge and the bucket pin and a straight line that indicates a bottom surface of the bucket;

a length of the bottom surface in the side view of the bucket;

a length from the bucket pin to at least one position on an outer side of the bucket between a portion that couples the bucket to the working unit and the blade edge;

an angle formed by the straight line that connects the blade edge and the bucket pin and a straight line from the bucket pin to at least one position on the outer side of the bucket between the portion that couples the bucket to the working unit and the blade edge;

a length of, in the side view of the bucket, a straight line that connects the bucket pin and a position of a bucket rear side end at the bottom surface; and an angle formed by the straight line that connects the blade edge and the bucket pin and the straight line that connects the bucket pin and the position of the bucket rear side end at the bottom surface, and wherein the generation unit:

changes first drawing information to include a first portion, that couples a bucket cylinder, which drives the bucket, and the arm of the working unit to the bucket, and second drawing information of a second portion which is a portion from the first portion to the blade edge, based on the information of the shape and size of the bucket using the first drawing information and the second drawing information;

obtains third drawing information by generating information of a figure that passes through at least one position on the outer side of the bucket between the first portion and the blade edge; and generates said drawing information using the first drawing information, the second drawing information, and the third drawing information.

3. The display system of a work machine according to claim 2, wherein the display unit displays, together with the image of the bucket viewed from the side, information of a target construction surface that indicates a target shape of a construction object of the work machine.

4. A work machine comprising the display system of the work machine according to claim 2.

5. A display method comprising:

generating drawing information to draw an image of a bucket, included in a work machine, viewed from a side using information of shape and size of the bucket;

displaying the image of the bucket viewed from the side and an image that indicates a cross-section of landform based on the drawing information generated by the generation unit;

changing first drawing information to include a first portion, that couples a bucket cylinder, which drives the bucket, and the arm of the working unit to the bucket, and second drawing information of a second portion which is a portion from the first portion to the blade edge, based on the information of the shape and size of the bucket using the first drawing information and the second drawing information;

obtaining third drawing information by generating information of a figure that passes through at least one position on the outer side of the bucket between the first portion to the blade edge; and generating said drawing information using the first drawing information, the second drawing information, and the third drawing information;

wherein the information of the shape and size of the bucket includes, in the side view of the bucket:

a distance between a blade edge of the bucket and a bucket pin that attaches the bucket to the working unit;

a distance between the bucket pin and a predetermined position at an outer side of the bucket; and an angle formed by a straight line that connects the bucket pin and the blade edge of the bucket and a straight line that connects the bucket pin and the predetermined position.

6. A display method comprising:

generating drawing information to draw an image of a bucket, included in a work machine, viewed from a side using information of shape and size of the bucket;

displaying the image of the bucket viewed from the side and an image that indicates a cross-section of landform based on the drawing information generated by the generation unit;

changing first drawing information to include a first portion, that couples a bucket cylinder, which drives the bucket, and the arm of the working unit to the bucket, and second drawing information of a second portion which is a portion from the first portion to the blade edge, based on the information of the shape and size of the bucket using the first drawing information and the second drawing information;

obtaining third drawing information by generating information of a figure that passes through at least one position on the outer side of the bucket between the first portion to the blade edge; and generating said drawing information using the first drawing information, the second drawing information, and the third drawing information;

wherein the information of the shape and size of the bucket includes, in the side view of the bucket:

a distance between a blade edge of the bucket and a bucket pin that attaches the bucket to the working unit;

an angle formed by a straight line that connects the blade edge and the bucket pin and a straight line that indicates a bottom surface of the bucket;

a length of the bottom surface in the side view of the bucket;

a length from the bucket pin to at least one position on an outer side of the bucket between a portion that couples the bucket to the working unit and the blade edge;

an angle formed by the straight line that connects the blade edge and the bucket pin and a straight line from the bucket pin to at least one position on the outer side of the bucket between the portion that couples the bucket to the working unit and the blade edge;

a length of, in the side view of the bucket, a straight line that connects the bucket pin and a position of a bucket rear side end at the bottom surface; and an angle formed by the straight line that connects the blade edge and the bucket pin and the straight line that connects the bucket pin and the position of the bucket rear side end at the bottom surface.

7. The display system of a work machine according to claim 1, wherein the display unit displays, together with the image of the bucket viewed from the side, information of a target construction surface that indicates a target shape of a construction object of the work machine.

8. A work machine comprising the display system of the work machine according to claim 1.

* * * * *